US006938552B2

(12) United States Patent
Tom et al.

(10) Patent No.: US 6,938,552 B2
(45) Date of Patent: Sep. 6, 2005

(54) CORROSION-RESISTANT STRUCTURE INCORPORATING ZINC OR ZINC-ALLOY PLATED LEAD OR LEAD-ALLOY WIRES AND METHOD OF MAKING SAME

(75) Inventors: Joe G. Tom, Vicksburg, MS (US); Philip G. Malone, Vicksburg, MS (US); Charles A. Weiss, Jr., Clinton, MS (US); Steven L. Larson, Vicksburg, MS (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 246 days.

(21) Appl. No.: 10/462,707

(22) Filed: Jun. 17, 2003

(65) Prior Publication Data

US 2004/0229076 A1 Nov. 18, 2004

(51) Int. Cl.[7] ..... B32B 15/02; F42B 30/02

(52) U.S. Cl. ..... 102/517; 86/54; 428/607; 428/658; 428/935; 205/244; 205/305

(58) Field of Search ..... 428/607, 645, 428/658, 659, 935, 605, 621; 102/501, 517; 86/54; 205/244, 245, 246, 305, 141, 210

(56) References Cited

U.S. PATENT DOCUMENTS

| | | | | |
|---|---|---|---|---|
| 2,168,381 A | * | 8/1939 | Woodford | 102/529 |
| 3,208,386 A | * | 9/1965 | Schneider et al. | 102/506 |
| 4,411,742 A | | 10/1983 | Donakowski et al. | |
| 4,786,377 A | * | 11/1988 | De Filippo et al. | 428/658 |
| 4,881,465 A | | 11/1989 | Hooper et al. | |
| 5,088,415 A | | 2/1992 | Huffman et al. | |
| 5,189,252 A | * | 2/1993 | Huffman et al. | 102/459 |
| 5,439,713 A | | 8/1995 | Yamaoka et al. | |
| 5,569,874 A | | 10/1996 | Nelson | |
| 5,618,634 A | | 4/1997 | Hosoda et al. | |
| 6,024,021 A | | 2/2000 | Schultz | |
| 6,095,052 A | | 8/2000 | Bean et al. | |
| 6,162,508 A | | 12/2000 | Trumble et al. | |
| 6,173,652 B1 | | 1/2001 | Taylor | |

FOREIGN PATENT DOCUMENTS

| | | | |
|---|---|---|---|
| JP | 60-017037 | * | 1/1985 |
| RU | 2057279 C1 | * | 3/1996 |

OTHER PUBLICATIONS

Lowenheim, Frederick A., Modern Electroplating, The Electrochemical Society, 1963, pp 409–411.*

* cited by examiner

*Primary Examiner*—John J. Zimmerman
(74) *Attorney, Agent, or Firm*—Earl H. Baugher, Jr.

(57) ABSTRACT

Structure incorporating lead is fabricated from specially prepared components such that mobility of the lead is impeded when the structure is exposed to an unprotected environment such as weathering outdoors or saltwater. In a preferred embodiment, a bullet or bullet core is swaged from a number of bunched electroplated fine lead or lead-alloy wires placed in a die. The lead or lead-alloy wires may be fabricated from lead or lead-alloy wool. The lead alloy may comprise zinc and antimony. The electroplating process plates zinc on the fine wires and may plate a zinc alloy such as zinc-aluminum. The plated surface may be coated with a corrosion resistant coating such as molybdenum phosphate. In addition to bullets and bullet cores, fishing weights, lead shielding, counterweights, ballast, and other lead containing structure may be fabricated or treated using methods and materials of the present invention.

63 Claims, 3 Drawing Sheets

A

B

CORROSION-RESISTANT STRUCTURE INCORPORATING ZINC OR ZINC-ALLOY PLATED LEAD OR LEAD-ALLOY WIRES AND METHOD OF MAKING SAME

STATEMENT OF GOVERNMENT INTEREST

Under paragraph 1(a) of Executive Order 10096, the conditions under which this invention was made entitle the Government of the United States, as represented by the Secretary of the Army, to the entire right, title and interest therein of any patent granted thereon by the United States. This patent and related ones are available for licensing. Contact Phillip Stewart at 601 634-4113.

FIELD OF THE INVENTION

The present invention relates generally to minimizing the mobility of lead introduced into an environment. In particular, it describes structure fabricated from zinc or zinc-alloy plated lead or lead-alloy wires, e.g., a bullet core or a fishing weight, and methods of making same.

BACKGROUND

Lead leaching into soil or water is a universal problem. There are many uses for lead, some of which are difficult to replace either economically or in performance. One is the use of lead in sporting and military ammunition. If ammunition could be fabricated from elements with nearly the same ballistic performance and economical cost as lead, the problems of lead leaching could be avoided. Unfortunately, in both performance and cost, lead is difficult to match. Thus an efficient and economical way to inhibit lead leaching in fabricating structure containing lead is desirable.

An approach to inhibiting lead leaching in bullets is found in U.S. Pat. No. 6,095,052, Corrosion Resistant Metal Body, Bullet Blank, and Bullet and Method for Making Same, to Bean et al., Aug. 1, 2000, incorporated herein by reference. The '052 patent describes the fabrication and structure of a composite bullet core consisting of a thick lead sheet covered by one or two thin zinc sheets or coatings. If two zinc sheets or coatings are used one would cover the top of the lead sheet and the other the bottom. In its most basic form, the '052 bullet core is formed by placing a thin zinc sheet over a thicker lead sheet and rolling the adjacent metal layers into a cylinder having the thin zinc sheet on the outside. This may be augmented by placing a thin zinc sheet on the reverse side also. The resultant cylinder may be pressed into any desired shape in a die and enclosed in a traditional bullet jacket, such as copper or copper alloy, to yield a finished jacketed bullet.

Although the bullet fabricated according to the method of the '052 patent affords measurable environmental benefits as compared to a conventional lead or lead-alloy bullet core, the possibility exists for lead or lead-alloy fragments to separate from the zinc sheets within the bullet upon impact. Thus what is needed is a lead or lead-alloy composite structure that under its normal use does not result in immediate exposure of a lead or lead-alloy surface to the environment. A preferred embodiment of the present invention affords this protection via use of fine zinc or zinc-alloy plated lead or lead-alloy wires as the base elements of structure formed by compressing a number of these fine wires into a solid of a pre-specified shape. A number of patents have addressed one or more aspects of the approach taken by the present invention. None have zinc or zinc-alloy plated fine lead or lead-alloy wire for use as a component of structure.

U.S. Pat. No. 4,411,742, Electrolytic Codeposition of Zinc and Graphite and Resulting Product, to Donakowski et al., Oct. 25, 1983, details a process for codepositing zinc and graphite on a substrate, and is incorporated herein by reference. The graphite is in the form of insoluble bulk graphite that is agitated in the same electrolysis tank as the zinc. The resultant surface has greatly improved corrosion resistance.

U.S. Pat. No. 4,881,465, Non-Toxic Shot Pellets for Shotguns and Method, to Hooper et al., Nov. 21, 1989, describes a pellet having ballistic characteristics similar to lead pellets but fabricated of an alloy of ferrotungsten suspended in a matrix of an alloy of mostly tin, antimony and lead, mostly lead. Since this pellet has less than 40% lead, it has been labeled non-toxic for its intended use.

U.S. Pat. No. 5,088,415, Environmentally Improved Shot, to Huffman et al., Feb. 18, 1992, provides shot with a density comparable to lead but less toxic because it has been coated with a chemically inert polymer. This shot is available in three forms. The first is polymer coated lead shot that is heated to above the melting point of the lead while otherwise maintaining its shape to both mechanically and chemically bond the polymer coating. The second form employs a metal with a density greater than lead, such as depleted uranium, coated with a metal such as zinc, bismuth, aluminum, tin, copper, iron, nickel or their alloys. The third form involves melting any of the lighter metals and adding powdered heavier metals such as tungsten or depleted uranium. Only the first form is claimed in the claims.

U.S. Pat. No. 5,439,713, Steel Wire Coated with Fe—Zn—Al Alloys and Method for Producing the Same, to Yamaoka et al., Aug. 8, 1995, uses a two-part immersion in a zinc molten bath followed by a zinc-aluminum molten bath to form the ternary Fe—Zn—Al coating on wire to be used to make strong corrosion resistant springs.

U.S. Pat. No. 5,569,874, Formed Wire Bullet, to Nelson, Oct. 29, 1996, describes a bullet formed in an entwined composite mass from a number of "elongate malleable elements" devoid of lead, e.g., copper wires. The wires are "woven" in a pre-specified pattern to form a bullet core. The wires are not described nor claimed as being coated or electroplated. A main attribute and claim, although not the basic claim, is that the wire contains no lead.

U.S. Pat. No. 5,618,634, Composite Zinc- or Zinc Alloy-Electroplated Metal Sheet and Method for the Production Thereof, to Hosoda et al., Apr. 8, 1997, incorporated herein by reference, describes an electroplated metal sheet and a plating solution that contains at least one organic compound to co-deposit carbon up to 10 wt-%. It yields improved post-painting corrosion resistance, press formability, and spot weldability. This composite zinc plating resists "powdering" during press forming.

U.S. Pat. No. 6,024,021, Fragmenting Bullet, to Schultz, Feb. 15, 2000, describes a bullet comprising a core of compressed lead rods surrounded by a copper jacket. The lead rods are not coated or electroplated.

U.S. Pat. No. 6,162,508, Molybdenum Phosphate Based Corrosion Resistant Conversion Coatings, to Trumble et al., Dec. 19, 2000, incorporated herein by reference, describes a molybdenum phosphate coating for zinc or zinc-alloy plated substrates that both significantly increases corrosion resistance and is a replacement for chromate coatings.

U.S. Pat. No. 6,173,652 B1, Environmentally Sealed Shot, to Taylor, Jan. 16, 2001, describes lead shot sealed on its exterior by a non-toxic layer that is resilient. One of the items in the coating used to seal the shot and make it "abhorrent" to birds is chili.

As applied specifically to bullets or bullet cores, corrosion resistant lead structure should have approximately the same ballistic performance as a conventional lead or lead alloy core. Thus, the amount of plating or coating of the lead should be minimized to facilitate ballistic performance, while optimized to enhance corrosion resistance. Further, although the cost of producing the "environmentally friendly" bullet of the present invention exceeds that of traditional lead or lead alloy bullets or bullet cores, it should be significantly less than for alternatives to lead or lead alloy such as tungsten, tantalum, tin, iron, polymers or alloys and combinations thereof. Preferred embodiments of the present invention address these requirements.

SUMMARY

Pieces of fine lead or lead-alloy wire (or lead or lead-alloy "wool" that may be pressed through a die into the shape of fine wire subsequently) are electroplated with zinc or a zinc alloy. The most common lead alloy is lead-antimony with the antimony generally present at 6% by weight or less. Common zinc alloys that may be employed include zinc-iron, zinc-cobalt, and zinc-nickel. In yet another embodiment, the zinc or zinc-alloy plate may be further coated to resist corrosion or erosion from abrasion. Appropriate numbers of the zinc or zinc-alloy plated pieces are then placed in a die and pressed into a desired solid shape for use, for example, as a bullet core or fishing weight. This method results in a product superior in environmental performance to the product of the '052 patent in that the plating process completely encapsulates the fine lead or lead-alloy wires while simplifying forming of the desired shape, e.g., a bullet core or "split shot" for fishing. The finished product has zinc metal distributed throughout, insuring that even a small fragment comprises zinc or zinc-alloy-encapsulated lead or lead alloy, except for an area in which any wire was cut along its diameter or abraded through the plating or coating and plating. Organic material may be added to the zinc or zinc-alloy plating tank in a manner such as that described in the '634 patent.

As a specific example, a preferred embodiment of the present invention simplifies the manufacture of a bullet core. Further, it yields a "composite" bullet core with a protective covering of zinc or zinc alloy on all but any ends of the fine wire that may be exposed by shear forces on sides of the wire that are abraded. This protection is enabled for even the smallest fragments of lead or lead alloy that may result from violent impact fracturing the core, continued abrasion, or weathering. The present invention significantly reduces the area of exposed lead or lead alloy when compared to the thickness of the lead or lead-alloy sheet that may exposed in applications using the '052 patent.

In fabricating bullet cores to demonstrate the efficacy of the present invention, fine lead wires were cut to the approximate length of the desired slug, oriented randomly, and pressed into bullet slugs in a die. After pressing, the wires appeared to be completely coalesced, i.e., the outside of the slug appeared smooth with no indication it was constructed from fine wires.

By regulating the plating process, it is possible to control the thickness of zinc or zinc-alloy plate applied to the wire and thus optimize ballistic performance as well as address the environmental impact requirements as measured by one or more standard TLCP tests of the EPA, such as the TCLP 1311 extraction described in EPA Publication SW-846, *Test Methods for Evaluating Solid Waste, Physical/Chemical Methods.*

In use as a bullet, electrochemical protection is enabled for all fragments produced when a jacketed, unjacketed, or partially jacketed (e.g., "soft tip" or "hollow point") bullet with a zinc or zinc-alloy plated lead or lead-alloy core of the present invention impacts on a soil berm or in a bullet trap. The inherent electrolytic protection significantly reduces the rate of leaching of the lead from the resultant composite of the present invention by maintaining the lead in its zero valance, or metal, form. That is, the lead is insoluble and not bio-available.

Steps in fabricating zinc or zinc-alloy plated structure in accordance with a preferred embodiment of the present invention include:

1. Providing fine lead or lead-alloy wire. This fine lead or lead-alloy wire may be formed from lead wool.
2. Cleaning the fine lead or lead-alloy wire with an appropriate cleaning or pickling liquid.
3. Cutting the fine lead or lead-alloy wire to a pre-specified length.
4. Electroplating zinc or an alloy of zinc on the fine lead or lead-alloy wire such that the zinc or zinc-alloy plated wire contains zinc within the range of 4 to 25% of the resultant weight of the plated wire.
5. Placing the zinc or zinc-alloy plated wire in a die of a pre-specified shape and size.
6. Compressing the zinc or zinc-alloy plated wire into a solid mass of a pre-specified shape and size.
7. Removing the solid mass thus formed from the die.

In an alternative embodiment, after step 4 the individual plated wires may be further coated to resist corrosion or erosion from abrasion.

Embodiments of the present invention may be used in any application where it is necessary to reduce or prevent the mobility of lead when it is exposed to an uncontrolled environment, such as weathering. The present invention is particularly suited to those applications where lead structure is subjected to sudden impact or gouging, expected or continuous abrasion, and weathering. Further examples include "environmentally friendly" radiation shielding material and weights for anchors or balancing.

DETAILED DESCRIPTION

A structure comprising mostly lead or lead alloy is fabricated to reduce the availability of the lead therein upon exposure of the structure to an unprotected environment. Steps in fabricating a zinc or zinc-alloy plated structure in accordance with a preferred embodiment of the present invention include:

1. Providing fine lead or lead-alloy wire of a size between approximately 0.8 mm (0.03 in.) and 2.5 mm (0.10 in.). This fine lead or lead-alloy wire may be formed from lead wool.
2. Cleaning the fine lead or lead-alloy wire with an appropriate cleaning or pickling liquid. One example of an appropriate pickling liquid is a solution of sodium fluoride (CAS No. 7681-49-4) and sodium bisulfate (CAS No. 7681-38-1) provided as Pickle #4 from Caswell, Inc., 5688 Telier Rd., Newark, N.Y. 14513.
3. Cutting the fine lead or lead-alloy wire to a pre-specified length suited to the plating bath and intended application in the final product.
4. Electroplating zinc or an alloy of zinc on the fine lead or lead-alloy wire such that the weight percent of zinc or zinc alloy in the plated wire is preferably between about 4 and 25 wt-%. More preferably, the weight percent of zinc or zinc alloy is between about 5 and 20 wt-% and most preferably, the weight percent of zinc or zinc alloy is between about 5 and 15 wt-% in the plated wire.
5. Placing the zinc or zinc-alloy plated wire in a die of a pre-specified shape and size.
6. Compressing the zinc or zinc-alloy plated wire into a solid mass of a pre-specified shape and size.
7. Removing the solid mass thus formed from the die.

Alternatively, after step 4, the resultant electroplated wire may be coated with a further protective coating such as molybdenum phosphate or graphite.

Figure 1:
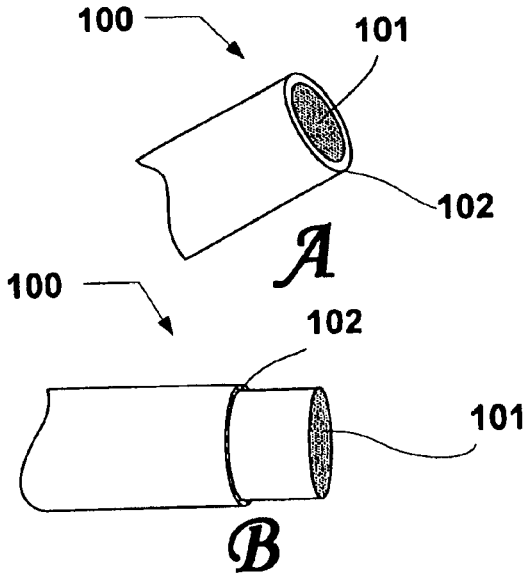
FIG. 1 shows two views of a plated wire, one cut across the diameter, the other partially stripped of plating, for illustration.

Refer to FIG. 1 in which a section of plated wire 100 is shown cut in A and in a perspective view partially stripped of plating 102 in B. Fine lead or lead-alloy wire 101, or lead (or lead-alloy) wool (not shown separately) spun into lead or lead-alloy wire 101, of approximately 0.8 mm (0.03") to 2.5 mm (0.10") diameter is cleaned using an appropriate solution, cut to a pre-specified length, and electroplated with zinc or a zinc alloy to a pre-specified thickness, most commonly measured as a weight percent of the resultant plated wire 100. The zinc may be alloyed with small amounts of aluminum (Al), iron (Fe), cobalt (Co), nickel (Ni), tin (Sn), or combinations of the alloying metals to effect a zinc-alloy plating. A source of carbon, such as insoluble graphite, may be introduced into the zinc-plating tank. The resulting zinc-carbon plating has improved corrosion resistance when compared to zinc plating alone. Further, the zinc or zinc-alloy plating may be coated with molybdenum phosphate ("MolyPhos") in an additional optional step prior to compressing the plated wires.

A preferred embodiment of the present invention inhibits the mobility of lead upon weathering of the resultant zinc or zinc-alloy plated lead or lead-alloy structure. For example, TLCP 1311 extraction tests of a conventionally formed 2-gram lead slug placed in a 0.1 N acetic solution for 24 hours, produced a concentration of 14.1 parts per million (ppm) of mobile lead. Under the same test conditions, a zinc-plated lead slug of similar dimensions to the above conventionally formed 2-gram lead slug, as fabricated in accordance with the present invention and containing 14% zinc and 86% lead by weight, produced a lead concentration of less than 0.2 ppm.

Figure 2:
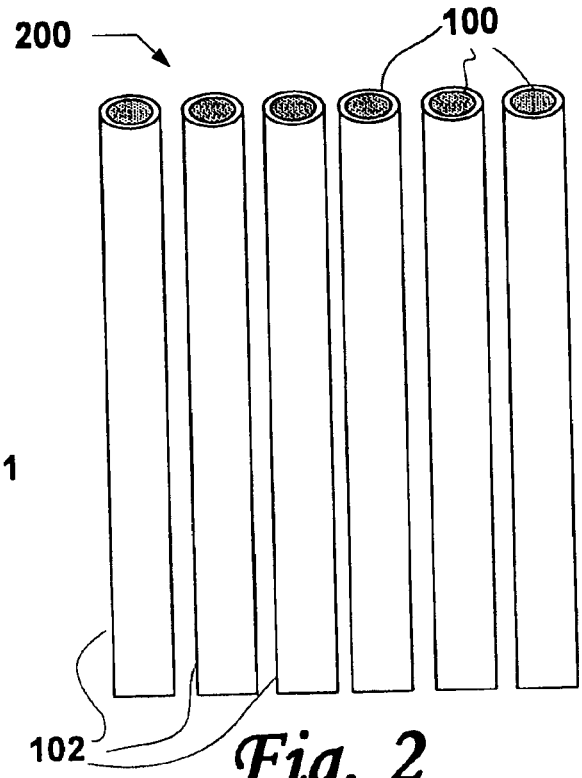
FIG. 2 shows a row of plated wires similar to the plated wire of FIG. 1, cut on one end for illustration, to illustrate the position of the plated portions one to the other.
Figure 3:
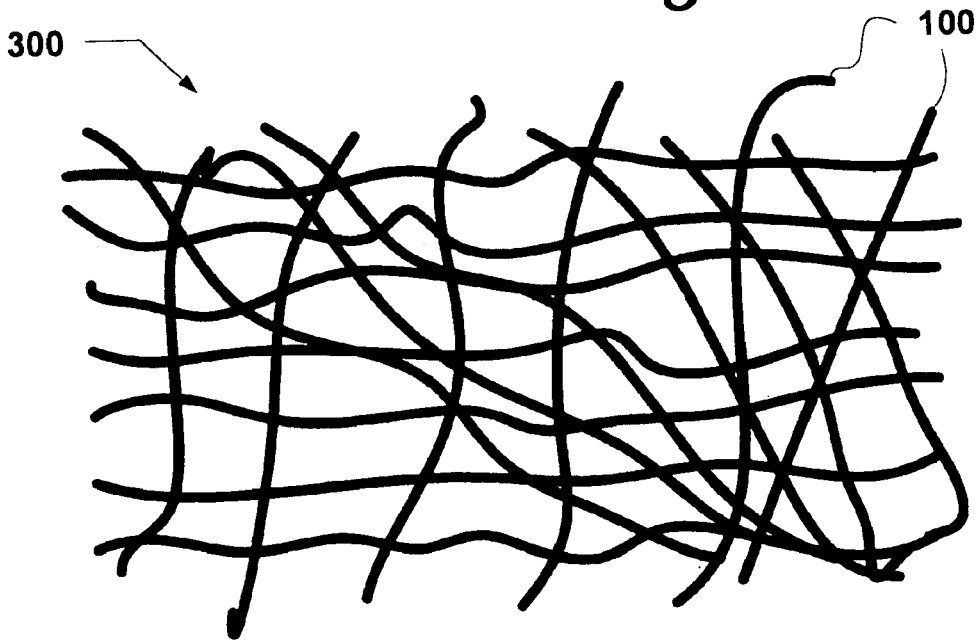
FIG. 3 shows plated wires similar to the plated wire of FIG. 1 akimbo for use in one embodiment of the present invention.

Refer to FIG. 2 in which an array 200 of several plated wires 100 are arranged in a row and cut at their tops to illustrate plating 102. The plating process used in the present invention distributes the zinc or zinc alloy evenly throughout the entire structure, e.g., a swaged bullet core or fishing weight. During the swaging (compressing) process the zinc or zinc alloy plate 102 is pressed against the neighboring zinc or zinc alloy plate 102 on surrounding plated wire 100 as shown in end view in FIG. 5. The zinc-to-zinc or zinc alloy-to-zinc alloy contact produces a layer that isolates the lead internally in each wire while reducing the opportunity for a single wire to be abraded to expose the lead therein.

The cost of materials for fabricating and plating the leach-resistant lead structure of the present invention is significantly less than for alternative materials to lead or lead alloys. For example, lead is approximately $0.30/lb and zinc is approximately $0.47/lb. Compare this with tungsten at a cost of $30/lb, a material used as a lead substitute in a number of shot and bullet applications.

EXAMPLE

Figure 4:
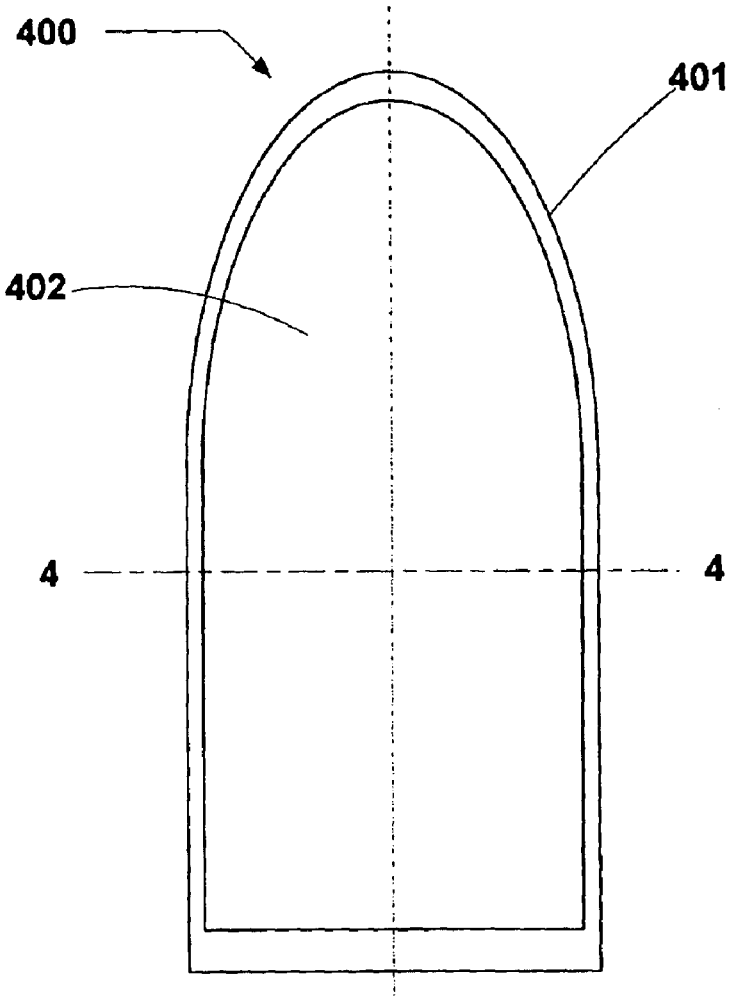
FIG. 4 shows a cross section of a jacketed bullet taken longitudinally, the core of which is made in accordance with an embodiment of the present invention in which the plated wires are aligned roughly parallel prior to compressing them into a solid mass.
Figure 5:
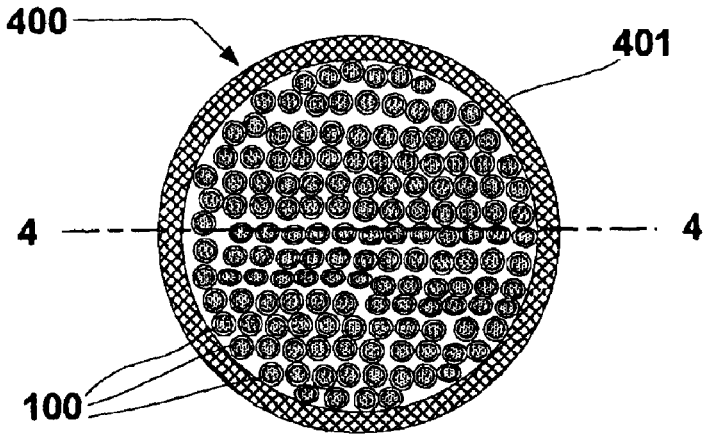
FIG. 5 shows a cross section of the jacketed bullet of FIG. 4 taken across its diameter.

Refer to FIGS. 4 and 5. A jacketed bullet 400 is shown cut along its length in FIG. 4. The jacket 401 may comprise copper or a copper alloy or other suitable material that both protects the lead or lead-alloy core 402 made in accordance with a preferred embodiment of the present invention and the barrel of the firearm from erosion and "leading." FIG. 5 shows a cross section of the jacketed bullet 400 taken through 4—4. The many fine lead or lead-alloy wires 100 that were compressed (swaged) to form the core 402 are shown as being essentially parallel when inserted into the bullet swage. As can be seen in FIG. 5, each wire 100 is plated so that the plating 102 of one wire 100 touches its immediate neighboring wires 100. If a bullet 400 were sheared exactly across its diameter as shown in FIG. 5, this would present the worst case for exposure of the lead (or lead alloy) 101 in the design of the present invention. The probability of shearing across the diameter is very low, however, given the actual use of bullets and it is unlikely that the fine lead wire would be bundled in a parallel array prior to forming a slug. Because of the plating 102 of the many individual fine wires 100 much less area is exposed than would be the case for a solid lead or lead-alloy core or even the "layered" helical core of the '052 invention. Further, in all other geometries of bullet damage, the lead or lead alloy exposed would be less than the layered lead/zinc or lead-alloy/zinc core of the '052 patent and much less than that for a conventional solid lead or lead-alloy core.

Figure 6:
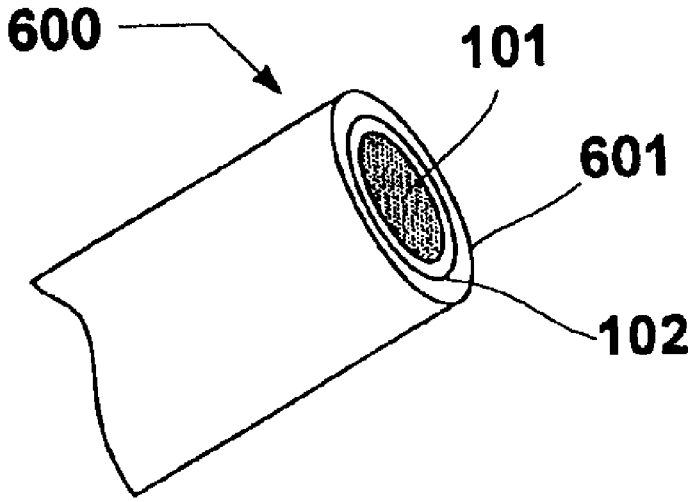
FIG. 6 shows two views of a plated wire that has been coated to further resist corrosion, abrasion, or erosion; one cut across the diameter, the other partially stripped of plating and final coating, for illustration.
Figure 6:
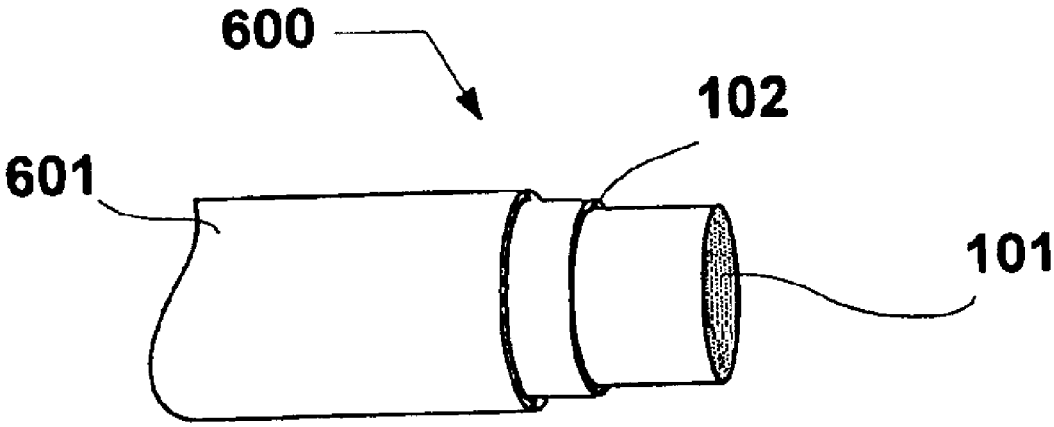

Refer to FIG. 6. As an option, zinc or zinc-alloy plated wires as described above may be coated with a corrosion resistant coating 601 to enhance corrosion, abrasion, and erosion resistance. This results in a multi-layer plated and coated wire 600 that may find application in environments where extreme corrosion is possible such as salt water or acid soils. The coating may comprise molybdenum phosphate, graphite, or any of a number of available commercial products that may contain either molybdenum phosphate or graphite.

While the invention has been described in terms of its preferred embodiments, those skilled in the art will recognize that the invention can be practiced with modifications within the spirit and scope of the appended claims. For example, although the system is described in specific examples for lead or lead-alloy bullet cores, it will work for fishing weights, ballast in sailboats, counterweights, lead shielding, or as a part of a process to prepare lead-contaminated objects, such as soldering benches, prior to disposal. Thus, it is intended that all matter contained in the foregoing description or shown in the accompanying drawings shall be interpreted as illustrative rather than limiting, and the invention should be defined only in accordance with the following claims and their equivalents.

We claim:

1. A component for fabricating structure, comprising:

fine lead wire having a diameter between approximately 0.8 mm (0.03 in.) and 2.5 mm (0.10 in.) cut to a pre-specified length, and a plating of at least some zinc on said fine lead wire, wherein said at least some zinc is electroplated upon said fine lead wire to result in a plating representing a pre-specified weight percent of said component.

2. The component of claim 1 in which said fine lead wire comprises a lead alloy.

3. The component of claim 1 in which said fine lead wire further comprises at least one first alloy material.

4. The component of claim 3 in which said first alloy material comprises at least antimony.

5. The component of claim 1 in which said plating further comprises at least one second alloy material.

6. The component of claim 5 in which said second alloy material comprises at least one material selected from the group consisting of carbon, aluminum, iron, cobalt, nickel, tin, and combinations thereof.

7. The component of claim 6 in which the weight percent of said second alloy material is less than about 5 weight percent of said component.

8. The component of claim 1 in which said plating is further coated with at least one corrosion inhibiting material.

9. The component of claim 8 in which said at least one corrosion inhibiting material is molybdenum phosphate.

10. The component of claim 1 in which said plating comprises a weight percent of said component of between about 4 and 25 weight percent.

11. The component of claim 1 in which said plating comprises a weight percent of said component of between about 5 and 15 weight percent.

12. Structure comprising a plurality of said components of claim 1 compressed to form said structure.

13. The structure of claim 12 in which said structure is a bullet.

14. The structure of claim 12 in which said structure is a core of a bullet.

15. A component for fabricating structure incorporating lead, comprising:

fine lead alloy wire having a diameter between approximately 0.8 mm (0.03 in.) and 2.5 mm (0.10 in.), said lead alloy comprising at least lead and antimony, and a plating of at least some zinc on said fine wire, wherein said at least some zinc is electroplated upon said fine wire to a pre-specified weight percent of said component.

16. The component of claim 15 in which said plating comprises a zinc alloy.

17. The component of claim 16 in which said zinc alloy comprises zinc and at least one material selected from the group consisting of carbon, aluminum, iron, cobalt, nickel, tin, and combinations thereof.

18. The component of claim 17 in which the weight percent of said alloy material in said zinc alloy is less than about 5 weight percent of said component.

19. The component of claim 15 in which said plating is further coated with at least one corrosion inhibiting material.

20. The component of claim 19 in which said at least one corrosion inhibiting material is molybdenum phosphate.

21. The component of claim 15 in which said plating comprises a weight percent of said component of between about 4 and 25 weight percent.

22. The component of claim 15 in which said plating comprises a weight percent of said component of between about 5 and 15 weight percent.

23. Structure comprising a plurality of said components of claim 15 compressed to form said structure.

24. The structure of claim 23 in which said structure is a bullet.

25. The structure of claim 23 in which said structure is a core of a bullet.

26. A method for fabricating structure containing at least some lead, said structure impairing mobility of said lead upon exposure of said structure to an unprotected environment, comprising:

providing fine wire having a diameter of between approximately 0.8 mm (0.03 in.) and 2.5 mm (0.10 in.), said fine wire incorporating at least some lead;

cleaning said fine wire;

cutting said fine wire to a pre-specified length;

electroplating at least some zinc on said fine wire;

placing said electroplated wire in a die of a pre-specified shape and size;

compressing said electroplated wire into a solid mass of a pre-specified shape and size; and removing said solid mass thus formed from said die.

27. The method of claim 26 in which said fine wire comprises a lead alloy.

28. The method of claim 27 in which said lead alloy comprises at least lead and antimony.

29. The method of claim 21 in which said line wire is formed from lead wool.

30. The method of claim 21 in which said fine wire is formed from lead-alloy wool.

31. The method of claim 21 in which said cleaning is accomplished using a pickling liquid.

32. The method of claim 21 in which said at least some zinc is incorporated in a zinc alloy.

33. The method of claim 32 in which said zinc alloy comprises zinc and at least one material selected from the group consisting of carbon, aluminum, iron, cobalt, nickel, tin, and combinations thereof.

34. The method of claim 33 in which the weight percent of said alloy material in said zinc alloy is less than about 5 weight percent of said structure.

35. The method of claim 26 in which said plating is further coated with at least one corrosion inhibiting material.

36. The method of claim 35 in which said at least one corrosion inhibiting material is molybdenum phosphate.

37. The method of claim 26 in which the weight percent of zinc in said plated fine wire is between about 4 and 25 weight percent of said structure.

38. The method of claim 26 in which the weight percent of zinc in said plated fine wire is between about 5 and 15 weight percent of said structure.

39. A method for fabricating a component to be used in structure containing at least some lead, said structure impairing mobility of said lead upon exposure of said structure to an unprotected environment, comprising:

providing fine lead wire having a diameter of between approximately 0.8 mm (0.03 in.) and 2.5 mm (0.10 in.);

cleaning said fine lead wire; and electroplating at least some zinc on said fine lead wire.

40. The method of claim 39 said fine wire comprising a lead alloy.

41. The method of claim 40 said lead alloy comprising at least lead and antimony.

42. The method of claim 39 forming said fine wire from lead wool.

43. The method of claim 39 forming said fine wire from lead-alloy wool.

44. The method of claim 39 accomplishing said cleaning using a pickling liquid.

45. The method of claim 39 providing said at least some zinc as a zinc alloy.

46. The method of claim 45 said zinc alloy comprising zinc and at least one material selected from the group consisting of carbon, aluminum, iron, cobalt, nickel, tin, and combinations thereof.

47. The method of claim 46 providing the weight percent of said alloy material in said zinc alloy at less than about 5 weight percent of said component.

48. The method of claim 39 coating said plating with at least one corrosion inhibiting material.

49. The method of claim 48 providing said corrosion inhibiting material as molybdenum phosphate.

50. The method of claim 39 providing zinc in said plated fine lead wire between about 4 and 25 weight percent of said structure.

51. The method of claim 39 providing zinc in said plated fine wire between about 5 and 15 weight percent of said structure.

52. A method for fabricating a component to be used in structure containing at least some lead, said structure impairing mobility of said lead upon exposure of said structure to an unprotected environment, comprising:

providing fine wire having a diameter of between approximately 0.8 mm (0.03 in.) and 2.5 mm (0.10 in.), said fine wire comprising a lead alloy;

cleaning said fine wire; and electroplating at least some zinc on said fine wire.

53. The method of claim 52 in which said lead alloy comprises at least lead and antimony.

54. The method of claim 52 in which said fine wire is formed from lead wool.

55. The method of claim 52 in which said fine wire is formed from lead-alloy wool.

56. The method of claim 52 in which said cleaning is accomplished using a pickling liquid.

57. The method of claim 52 in which said at least some zinc is incorporated in a zinc alloy.

58. The method of claim 57 in which said zinc alloy comprises zinc and at least one material selected from the group consisting of carbon, aluminum, iron, cobalt, nickel, tin, and combinations thereof.

59. The method of claim 58 in which the weight percent of said alloy material in said zinc alloy is less than about 5 weight percent of said component.

60. The method of claim 52 in which said plating is further coated with at least one corrosion inhibiting material.

61. The method of claim 60 in which said at least one corrosion inhibiting material is molybdenum phosphate.

62. The method of claim 52 in which the weight percent of zinc in said plated fine wire is between about 4 and 25 weight percent of said structure.

63. The method of claim 52 in which the weight percent of zinc in said plated fine wire is between about 5 and 15 weight percent of said structure.

* * * * *